US007570232B2

(12) United States Patent
Maede et al.

(10) Patent No.: US 7,570,232 B2
(45) Date of Patent: Aug. 4, 2009

(54) ORGANIC EL DRIVE CIRCUIT AND ORGANIC EL DISPLAY USING SAME

(75) Inventors: Jun Maede, Kyoto (JP); Shinichi Abe, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 266 days.

(21) Appl. No.: 10/593,904

(22) PCT Filed: Mar. 22, 2005

(86) PCT No.: PCT/JP2005/005124

§ 371 (c)(1),
(2), (4) Date: May 4, 2007

(87) PCT Pub. No.: WO2005/091266

PCT Pub. Date: Sep. 29, 2005

(65) Prior Publication Data

US 2007/0278965 A1 Dec. 6, 2007

(30) Foreign Application Priority Data

Mar. 24, 2004 (JP) ..... 2004-087014

(51) Int. Cl.
*G09G 3/32* (2006.01)

(52) U.S. Cl. ..... 345/76; 345/82

(58) Field of Classification Search ..... 345/76, 345/77, 78, 79, 82, 83; 315/169.1, 169.2, 315/169.3

See application file for complete search history.

(56) References Cited

U.S. PATENT DOCUMENTS

| | | | | |
|---|---|---|---|---|
| 7,170,479 | B2 * | 1/2007 | Kimura | 345/82 |
| 7,205,967 | B2 * | 4/2007 | Morishige et al. | 345/77 |

FOREIGN PATENT DOCUMENTS

| | | |
|---|---|---|
| JP | 2003-228333 | 8/2003 |
| JP | 2003-234655 | 8/2003 |
| JP | 2003-255880 | 9/2003 |
| JP | 2003-271097 | 9/2003 |
| JP | 2003-288045 | 10/2003 |

* cited by examiner

*Primary Examiner*—David Hung Vu
(74) *Attorney, Agent, or Firm*—Mattingly & Malur, PC

(57) ABSTRACT

To provide an organic EL drive circuit capable of reducing luminance variation or luminance unevenness of a display device while restricting an increase of circuit side even when reference currents are not uniform or the current conversion accuracy of D/A converters for converting display data according to the reference currents is some what low and an organic EL display device using the same organic EL drive circuit.

A selection circuit for selecting a predetermined current (reference current or reference drive current) is provided between each of current generator circuits and each of current sources provided correspondingly to output terminals of driver to select one of a predetermined current of the current generator circuit corresponding to the output terminal assigned thereto and a predetermined current from a current generator circuit adjacent to the current generator circuit correspondingly to a row side scanning. The selection is performed correspondingly to, for example, a row side scan of a horizontal one line.

11 Claims, 4 Drawing Sheets

ORGANIC EL DRIVE CIRCUIT AND ORGANIC EL DISPLAY USING SAME

TECHNICAL FIELD

This invention relates to an organic EL drive circuit and an organic EL display device. Particularly, in a current drive circuit for driving a column line of an organic EL display panel (a drive line on the anode side of organic EL elements), the invention relates to a drive circuit of an organic EL display device, which is capable of reducing luminance variation of display device and unevenness of luminance of a display device even when reference currents generated correspondingly to output terminals provided correspondingly to column lines are not uniform or even when preciseness of current conversion of D/A converters for converting display data according to reference currents is somewhat low.

BACKGROUND ART

An organic EL display panel of an organic EL display device mounted on a portable telephone set, a PHS, a DVD player or a PDA (digital portable terminal device) and having 396 (132×3) terminal pins for column lines and 162 terminal pins for row lines has been proposed and the number of the terminal pins for column lines and row lines tends to increase further.

Incidentally, a drive circuit for an organic EL display panel, which is constructed with D/A converter circuits provided correspondingly to column pins, is disclosed in JP2003-234655A (Patent Reference 1) of the applicant of this application. In the drive circuit disclosed in Patent Reference 1, the D/A converter circuits provided correspondingly to the column pins receive display data and a reference drive current, converts the digital display data into an analog signal according to the reference drive current and generates drive currents corresponding to the respective column pins or a current on which the drive currents are generated.

Patent Reference 1: JP2003-234655A

In order to reduce power consumption, a power source voltage of the D/A converter is as low as about DC3V and a power source voltage of only the last stage current source is, for example, DC15V to 20V. The D/A converters convert the reference currents distributed correspondingly to the respective column pins (or output terminals) into currents, from which drive currents of organic EL elements (referred to "OEL elements", hereinafter) are generated, and the output stage current sources are driven thereby. Thus, power consumption of the whole current drive circuit is restricted.

The D/A converters formed as an IC are provided correspondingly to the pins. Therefore, in order to restrict an area to be taken by the IC, each of the D/A converters is of about 4 to 6 bits. The reference drive current supplied to each D/A converter is the reference current distributed to the respective output terminals of the column drivers by a reference drive current distribution circuit. The reference drive current distribution circuit is constructed with a current mirror circuit having an input side transistor and a plurality (n) of output side transistors, where n corresponds to the number of output terminals. A reference current generated by the reference current generator circuit is supplied to the input side transistor of the current mirror circuit and are distributed from the output side transistors to the D/A converter circuits provided correspondingly to the respective output terminals. Incidentally, since the output terminals of the driver IC are connected to the respective column pins of the organic EL display panel, the output terminals correspond to the respective column pins.

DISCLOSURE OF THE INVENTION

Problem to be Solved by the Invention

In the case where organic EL display panel is a color organic EL display panel, the driver IC of the organic EL display panel has 30 output terminals or more for each of R, G and B colors and the reference currents are generated and distributed to the respective output terminals by the reference current distribution circuit. Therefore, unevenness of the distributed reference currents tends to occur due to difference of characteristics of the output side transistors of the reference current distribution circuit and the arrangement of the transistors. Such unevenness is reflected to the luminance variation of display devices or the unevenness of luminance of a display device.

When the drive circuit of the organic EL display panel drives the output stage current sources by using the D/A converters each of 4 to 6 bits to drive the OEL elements through the respective column pins (respective output terminals), the drive currents corresponding to the column pins tend to vary due to low preciseness of current conversion of the D/A converter circuits. Such unevenness of the drive current is reflected to the luminance variation of display devices or the unevenness of luminance of a display device.

Therefore, the drive IC requires regulation circuits for regulating the reference drive currents to be supplied to the D/A converters for the respective output terminals, additionally. Thus, the area to be taken by the IC driver is increased.

On the other hand, when, in order to improve the preciseness of D/A conversion, D/A converters each having more than 6 bits, are used, the area to be taken by the current drive circuit of the driver IC is increased since such D/A converters are to be provided correspondingly to the column pins. Therefore, a large number of the output terminals may not be provided.

An object of the present invention is to provide a organic EL drive circuit capable of reducing luminance variation of display devices and unevenness of luminance of a display device even when the reference currents generated correspondingly to the output terminals of the driver IC are not uneven or the preciseness of the current conversion of the D/A converter circuits for converting the display data according to the reference current is somewhat low and to provide an organic EL display device using the organic EL drive circuit.

Means for Solving the Problem

In order to achieve the object of the present invention, an organic EL drive circuit for current-driving an organic EL display panel by generating drive currents or a current, on which the drive currents are generated, correspondingly to respective output terminals connected to a plurality of column pins or terminal pins, comprises a plurality of current generator circuits provided correspondingly to the output terminals for generating predetermined currents correspondingly to the output terminals, respectively, a plurality of current sources provided correspondingly to the output terminals and, in response to the predetermined currents from the current generator circuits corresponding to the output terminals, for generating the drive currents or the current, on which the drive currents are generated, corresponding to the output terminals, respectively and a plurality of selection circuits provided between the current generator circuits and the current sources corresponding to the output terminals, respectively, wherein each of the selection circuits selects the predetermined current of the current generator circuit corresponding to the output terminal assigned to the selection circuit or the predetermined current from the current generator circuit corresponding to the output terminals adjacent to the current generator circuit, corresponding to a row side scanning or a scan line scanning.

Advantage of the Invention

In the present invention, the selection circuits are respectively provided between the current generator circuits and the current sources, which are provided correspondingly to the output terminals of the driver, and each of the selection circuits selects the predetermined current of the current generator circuit corresponding to the output terminal assigned to the selection circuit or a predetermined current from the current generator circuit corresponding to an output terminal adjacent to the current generator circuit, correspondingly to the row side scanning or the scan line scanning. And, for example, the selection is performed correspondingly to the row side scanning for one horizontal line or the scan line scanning.

Therefore, the predetermined current (reference current or reference drive current) from the assigned current generator circuit corresponding to the output terminal assigned to each of the current sources and the predetermined current (reference current or reference drive current) from the current generator circuit adjacent to the assigned current generator circuit are time-divisionally supplied to each current source. Therefore, the drive currents outputted to OEL elements from the respective output terminals are generated correspondingly to the row side scanning for one horizontal line or the scan line scanning on the basis of different reference currents, time-divisionally.

Thus, the reference current value is averaged in terms of time, so that unevenness of luminance of the OEL elements is integrated in terms of time and the luminance unevenness is averaged.

With this averaging of the reference current value in terms of time, the luminance variation for display devices and luminance unevenness of a display device can be restricted.

Further, since each selection circuit is provided between the current generator circuit, which is provided correspondingly to the output terminal of the driver, and the current source for generating a drive current or a current on which the drive current is generated and the selection circuit is positioned on an upstream side of the driver current outputted to the OEL element, the current to be switched can be reduced. Therefore, it is possible to reduce the size of the whole circuit including the selection circuits. In particular, even when 2 or 3 switching circuits are provided, the reducing effect of luminance unevenness and luminance variation according to the present invention is considerable.

As a result, it is possible to reduce luminance unevenness and luminance variation even when the reference currents generated correspondingly to the output terminals of the driver are varied or the current conversion preciseness of the D/A converters for converting the display data into analog currents according to the reference currents is somewhat low, while restricting increase of circuit size.

BEST MODE FOR CARRYING OUT THE INVENTION

FIG. 1 is a block circuit diagram according to an embodiment of the organic EL display panel to which an organic EL drive circuit is applied, mainly showing a reference current switching circuit in column drivers of the organic EL display panel, FIG. 2 shows connections between multiplexers and a ring counter, FIG. 3 is a timing chart of reference current switching processing and FIG. 4 is a block circuit diagram of the organic EL display panel.

In FIG. 4, a reference numeral 10 depicts a column IC driver (referred to as "column driver", hereinafter) as the organic EL drive circuit of the organic EL display device. The column driver 10 is constructed mainly with a reference current generator circuit 1, a reference current setting circuit 2, a current distribution circuit 3, a reference current switching circuit 4, D/A converter circuits 5, output stage current sources 6, a ring counter 7 and a register 8. The D/A converters 5 and the output stage current sources 6 are provided correspondingly to output terminals Xa to Xm. When the organic EL display panel is a color display device, the reference current setting circuit 2 and the current distribution circuit 3 are provided for each of R(red), G(green) and B(blue) and the D/A converter 5 and the output stage current sources 6 are provided for each of the output terminals for R, G and B.

Since circuit constructions for R, G and B are similar, the embodiments will be described regardless of colors.

The reference current setting circuit 2 includes D/A converter circuit 2*a* of about 4 bits and generates a reference current Ir regulated correspondingly to respective display colors for white balance regulation. The regulation of the reference current Ir is performed on the basis of a conversion data set in the D/A converter circuit 2*a* and a reference current Iref. The reference current setting circuit 2 is driven by the reference current Iref from the reference current generator circuit 1. 4-bit data is supplied to an MPU 11 as an external input data, and stored in a register 2*b* of the reference current setting circuit 2 and then in the D/A converter 2*a*. The D/A converter circuit 2*a* converts the data stored in the register 2*b* to generate a current having a predetermined reference value as the reference current Ir. The thus generated reference current Ir is supplied to an input side transistor Tra of the current distribution circuit 3 (referred to as "current mirror circuit", hereinafter) constructed with a current mirror circuit. Therefore, output side transistors Trb to Trn of the current mirror circuit 3 generate the reference currents Ir, which are distributed to the respective output terminals Xa to Xm.

The current mirror circuit 3 includes an input side P channel MOSFET Tra and the output side P channel MOSFET's Trb to Trn current-mirror-connected to the input side transistor Tra. Sources of the transistors Trb to Trn are connected to a power source line +V (=+3V). Incidentally, the output side transistors Trb to Trn are provided correspondingly to the output terminals Xa to Xm.

The current mirror circuit 3 further includes output side P channel MOSFET's Tda and Tdm connected in current-mirror to the input side transistor Tra. The transistors Tda and Tdm constitute dummy circuits Da and Dm, which will be described later. Drains of the transistors Trb to Trn are selectively connected to the D/A converter circuits 5 connected to the output terminals Xa to Xm through the reference current switching circuits 4 or those adjacent to the D/A converter circuits. The reference currents Ir outputted from the respective drains become the reference drive currents of the D/A converter circuits 5 connected thereto. One of the reference currents Ir inputted to the D/A converter circuit corresponding to one of the output terminals Xa to Xm and another of the reference currents Ir inputted to the D/A converter circuit 5 connected to another output terminal adjacent thereto is selected by the reference current switching circuit 4 periodically and the selected reference current Ir is inputted to the D/A converter circuit corresponding to the selected output terminal.

In other words, the D/A converter circuit 5 assigned to one of the output terminals Xa to Xm receives not only the reference current Ir corresponding to the assigned output terminal but also the reference current Ir of the output terminal adjacent to the assigned output terminal.

Thus, the D/A converter circuit 5 time-divisionally generates the drive current of the output stage current source 6 corresponding to the assigned output terminal periodically on the basis of reference current Ir corresponding to the adjacent output terminal.

As a result, the reference current value is averaged in terms of time and the drive current of the OEL element is integrated in terms of time, so that the luminance unevenness is averaged.

Each D/A converter circuit 5 amplifies the reference current Ir generated by the reference current setting circuit 2 according to the display data from the MPU 11 through the register 8 to generate the drive current corresponding to luminance of the OEL element every time to thereby drive the output stage current source 6.

The output stage current source 6 is constructed with a current mirror circuit including a pair of transistors and outputs a drive current i to an anode of the OEL element of the organic EL display panel through one of the column side output terminals Xa to Xm.

Switch circuits SWR1, SWR2, . . . SWRm are provided correspondingly to the output terminals Xa to Xm as shown in FIG. 2 and reset the output terminals to a constant voltage VZR. In response to reset control pulses RS (or reset pulses) from the control circuit 12, the switch circuits SWR1, SWR2, . . . SWRm are turned ON in a reset period, so that the anode sides of the OEL elements are set to the constant voltage VZR of a Zener diode DZR to precharge (or constant voltage reset) the OEL elements. Incidentally, in this case, cathode sides of the OEL elements are grounded with a predetermined timing.

In response to the reference current switching pulse SEL from the ring counter 7 in the reset period, the reference current switching circuit 4 sequentially selects 3 continuous reference currents Ir correspondingly to a period of a horizontal frequency one by one and supplies the selected reference currents to the D/A converter circuit 5 corresponding to one of the output terminals Xa to Xm. One of the three reference currents Ir is distributed to the one output terminal by the current distribution circuit 3 and the remaining 2 reference currents are for output terminals adjacent to the one output terminal.

As shown in FIG. 2, the ring counter 7 is constructed with a 3-stage flip-flop circuit FF having an input and an output connected to the input. In response to a row clock RCLK from the control circuit 12 (or a reset control pulse RS), bit "1" set in the initial stage flip-flop of the ring counter 7 is shifted to the second stage flip-flop and then to the last stage flip-flop sequentially and the bit "1" in the last stage flip-flop is returned to the initial stage flip-flop.

Outputs of the respective stage flip-flops of the ring counter 7 are supplied to multiplexers 4*a* to 4*m*, 4*da* and 4*dm* (FIG. 2) as the reference current switching pulses SEL. The reference current switching pulse SEL is composed of terminal selection pulses SEL1, SEL2 and SEL3.

Incidentally, the row clock RCLK (FIG. 3(*b*)) and the reset control pulse RS (FIG. 3) are control signals for horizontal scan and correspond to the scan frequency for one horizontal line. The ring counter 7 shifts bit "1" sequentially according to the row clock RCLK.

Returning to FIG. 1, the current sources 3*a* to 3*m* represent the output side transistors Trb to Trn of the current mirror circuit 3, respectively. The current source 3*a* corresponds to the output side transistor Trb, the current source 3*b* corresponds to the transistor Trc and so on. The current source 3*m* corresponds to the transistor Trn.

As shown in FIGS. 1 and 4, the column driver 10 further includes outputs corresponding to the output terminals Xa to Xm and dummy circuits Da and Dm having dummy output terminals Xda and Xdm, respectively. The dummy circuits Da and Dm are provided adjacent to the initial multiplexer 4*a* and the last multiplexer 4*m*, which have no adjacent output terminals, respectively.

The reference current switching circuit 4 includes the multiplexers 4*a* to 4*m*, which are provided correspondingly to the respective output terminals Xa to Xm, and the multiplexers 4*da* and 4*dm*, which are provided correspondingly to the respective dummy output terminals Xda and Xdm. The dummy output terminals Xda and Xdm are provided such that each of the multiplexers 4*a* to 4*m* corresponding to the output terminals Xa to Xm can select one of the three reference currents Ir, that is, the reference current Ir assigned thereto and the two adjacent reference currents Ir. In order to realize this, the dummy output terminal Xda and the multiplexer 4*da* before the output terminal Xdm and the dummy output terminal 4*dm* and the multiplexer 4*dm* after the output terminal Xm are necessary.

The dummy circuit Da includes the transistor Tda provided before the transistor Trb and the dummy circuit Dm includes the transistor Tdm provided after the transistor Trn. The transistors Tda and Tdm are shown as current sources 3*da* and 3*dm*, respectively.

Incidentally, although, in FIG. 4, the dummy circuits Da and Dm are not arranged as mentioned above for the sake of explanation, the current sources 3*a* to 3*m* and the current sources 3*da* and 3*dm* are the output side transistors of the current mirror circuit 3 and correspond to the current generation circuit for generating the distributed reference current Ir.

Correspondingly to each of the current sources 3*da* and 3*dm*, a dummy D/A converter circuit 5 and a dummy output stage current source 6 are provided. Outputs of the dummy current sources 6 are connected to the dummy output terminals Xda and Xdm, respectively.

Each of the multiplexers 4*a* to 4*m*, 4*da* and 4*dm* is a selection circuit having 3 inputs and 1 output. In the transistor arrangement of the outputs (drains) of the output side transistors Trb to Trm of the current mirror circuit 3 corresponding to the output terminals Xa to Xm and the outputs (drains) of the output side transistors Tda and Tdm corresponding to the output terminals Xda to Xdm, the three input terminals are sequentially connected to the three inputs of each of the multiplexers. The outputs of the multiplexers 4*a* to 4*m* are connected to the inputs of the D/A converters 5 corresponding to the assigned output terminals among the output terminals Xa to Xm, respectively.

Incidentally, the first input terminal of the multiplexer 4*da* and the last input terminal of the multiplexer 4*dm* are grounded.

The multiplexer 4*a* sequentially selects one of the three input terminals circularly according to the reference current switching pulse SEL (terminal selection pulses SEL1, SEL2 and SEL3) from the ring counter 7 to send one of the reference currents Ir from the current source 3*a*, which corresponds to one of the output terminals Xa to Xm, and the current sources 3*da* and 3*b*, which correspond to the output terminals on both sides thereof, to the D/A converter circuit 5 corresponding to the multiplexer 4*a*.

Similarly, the multiplexer 4*b* sequentially selects one of the three input terminals circularly according to the reference current switching pulse SEL from the ring counter 7 to send one of the reference currents Ir from the current source 3*b*, which corresponds to the assigned output terminal and from the current sources 3*a* and 3*c*, which correspond to the output terminals on both sides thereof, to the D/A converter circuit 5 corresponding to the multiplexer 4*b*.

The last multiplexer 4*m* sequentially selects one of the three input terminals circularly according to the reference current switching pulse SEL from the ring counter 7 to send one of the reference currents Ir from the current sources 3*m*−1, 3*m* and 3*dm* to the D/A converter circuit 5 corresponding to the multiplexer 4*m*.

FIG. 2 shows a connection between the multiplexers of the reference current switching circuit 4 and the ring counter.

Since the connections between the multiplexers 4*a* to 4*m*, 4*da* and 4*dm* and the ring counter 7 are the same, a connection between a multiplexer 40 as a representative of these multiplexers and the ring counter 7 is shown in FIG. 2.

As shown in FIG. 2, the ring counter 7 is constructed with a three stage flip-flop circuit FF having an input and an output connected to the input so that the output of the last stage can be fed back to the input of the first stage. The terminal selection pulse SEL1 is generated from the first stage output. The terminal selection pulse SEL2 is generated from the second stage output and the terminal selection pulse SEL3 is generated from the last stage output.

Since, in response to the row clock RCLK (or the reset control pulse RS), bit "1" set in the initial stage is shifted to the second stage and then to the last stage sequentially, one of the terminal selection pulses SEL1, SEL2 and SEL3 becomes "1" or "H" (High level) sequentially and the remaining two terminal selection pulses become "0" or "L" (Low level). Therefore, one of analog switches SWA, SWB and SWC connected to the three input terminals, respectively, is sequentially turned ON and the remaining two analog switches are turned OFF.

Incidentally, the ring counter 7 is activated by a row scan start pulse RSTP generated every frame corresponding to a vertical sync signal (FIG. 3(*a*)).

The multiplexer 40 has input terminals A, B and C and an output terminal D. The analog switches SWA, SWB and SWC, which may be transmission gates, etc., are provided between the input terminals A, B and C and the output terminal D. The output terminal D is connected to the D/A converter corresponding to the assigned output terminal among the output terminals Xa to Xm, the input terminal B is connected to the current source 3*i* corresponding to the output terminal assigned thereto and the input terminals A and C are connected to the current sources 3*i*−1 and 3*i*+1 corresponding to the output terminals on both side of the current source 3*i*, respectively.

Now, the drive operation of the reference current switching circuit will be described, mainly.

In response to the row scan start pulse RSTP shown in FIG. 3(*a*), the control circuit 12 (or the MPU 11) sets "1" in the initial stage of the ring counter 7. This "1" is sequentially circulated according to the row clock RCLK shown in FIG. 3(*b*). Incidentally, FIG. 3(*c*) shows the reset control pulse RS.

As a result, the terminal selection pulses SEL1, SEL2 and SEL3 become "H" sequentially in the order for only a period between rising edges of the row clock RCLK and, otherwise, remain "L" as shown in FIGS. 3(*d*) to 3(*f*).

Thus, the analog switches SWA, SWB and SWC are turned ON sequentially in the order according to the row clock RCLK and, otherwise, remain OFF. The input terminals A, B and C of each multiplexer 40 are sequentially selected correspondingly to three row line outputs (row side scanning of horizontal 1 line) shown in FIG. 3(*g*) and connected to the output terminal D.

That is, the multiplexers 4*a* to 4*m* are switched simultaneously to the same input terminal sides. Thus, the same input terminals of the multiplexers are selected simultaneously. For example, when the input terminals A, B, C, A, B, C, . . . of the multiplexers are switched in the order, the multiplexers 4*a* to 4*m* sequentially select the input side current sources in the order of the current source 3*i*−1, the current source 3*i*, the current source 3*i*+1, the current source 3*i*, the current source 3*i*+1, . . . (i=a to m, 3*a*−1=3*da*, 3*m*+1=3*dm*) and this selection is repeated.

As a result, the reference current switching circuit 4 sequentially selects one of the three reference currents Ir from the current source 3*i* corresponding to the assigned output terminal of the output terminals Xa to Xm and from the output terminals on both sides of the assigned output terminals and sends the selected reference current Ir to the D/A converter circuit 5 corresponding to the assigned output terminal for a period, which is a sum of the scan period for one horizontal line and the retrace period, with units of row side scan (vertical scan) of three horizontal lines.

Incidentally, the cathode side of the OEL elements for one horizontal line becomes a predetermined potential simultaneously by the row line output. Usually, the cathodes of the OEL elements for one horizontal line are grounded by the row line output and, after the output terminals Xa to Xm are reset by the reset control pulse RS or the reset pulse, the drive currents from the current sources 3*a* to 3*m*, 3*da* and 3*dm* are sent to the output terminals of the column line.

Incidentally, since the number of column pins is very large, a plurality of column drivers are allotted to the output terminals connected to the respective column pins for one horizontal line.

Incidentally, in this embodiment, the switching is sequentially performed such that one of the terminal selection pulses SEL1, SEL2 and SEL3 becomes "H" according to the rising edge of the row clock RCLK while the remaining terminal selection pulses become "L". However, since the reset control pulse RS rises with the same timing of the rising of the row clock RCLK as shown in FIG. 3(*c*), it is possible to generate the reference current switching pulses SEL (SEL1, SEL2 and SEL3) according to the rising edge of the reset control pulse RS instead of the row clock RCLK.

As such, each D/A converter circuit 5 receives the reference current Ir from the current source 3*i* corresponding to the output terminal of the output terminals Xa to Xm, which is assigned to the D/A converter circuit 5, and the reference currents Ir from the current sources 3*i*−1 and 3*i*+1 on the both sides of the current source 3*i* correspondingly to the scan of three row lines in the vertical scan (row side scan).

As a result, the drive current generated by the selected reference current Ir flows to each of the output terminals Xa to Xm in scanning of every horizontal line of units of three row lines (horizontal lines) in the vertical scan (row side scan) time-divisionally. Therefore, the reference current Ir is averaged in terms of time and luminance variation caused by three drive currents in the three horizontal lines is integrated in terms of time so that luminance of the OEL element driven by the drive current, which is generated by the reference current Ir of each of the output terminals Xa to Xm, is averaged in units of three horizontal lines.

Therefore, in this embodiment, even when there is variation of the reference currents corresponding to the output terminals or even when the current conversion preciseness of the D/A converters is somewhat low, it is possible to reduce luminance unevenness and luminance variation.

Particularly, in this embodiment, the reference current switching circuit 4 is provided between the current mirror circuit 3 and the D/A converter 5. Therefore, the switched current value is as small as several μA and substantially no noise generated by the switching so that useless power consumption generated by the switching can be reduced. Further, the circuit size of the analog switches SWA, SWB and SWC such as the transmission gates, etc., is not substantially increased.

As a result, it is possible to restrict the circuit size of the reference current switching circuit 4.

Incidentally, the current distribution circuit 3 of this embodiment distributes the reference currents Ir having the same value as that of the input side reference current Ir as the reference currents of the D/A converters. However, the reference currents distributed to the corresponding output terminals are not always the same as the input side reference current. It may be possible to use ones obtained by amplifying the input side reference current Ir as the reference currents.

Further, in the described embodiment, the multiplexers select the three reference currents with units of three row side scan lines (one horizontal line). However, the number of reference currents to be selected is not limited to three. It is possible to average luminance variation by integrating the luminance variation in terms of time since any number of reference currents Ir are averaged in terms of time so long as the number is plural.

Further, in the described embodiment, the switching of the multiplexers is performed in units of one horizontal line. However, the switching of multiplexer may be performed every period of a plurality (n) of horizontal lines in units of a plurality of row side scan lines. Further, it is possible to perform the switching of multiplexers according to the row scan start pulse RSTP every frame in units of scan period for all row lines or the vertical sync signal every in frame unit. Therefore, it is enough to perform the multiplexer switching correspondingly to the scanning in the row side scan (vertical scan) of at least one horizontal line.

Further, in the described embodiment, the ring counter 7 sequentially shifts the bit "1". However, it is possible to reset all of the stages of the ring counter 7 to bit "1" and shift the bit "0". Since, in such case, "H" and "L" are reversed, the analog switches SWA, SWB and SWC are sequentially turned ON by providing inverters on demand.

Although, in the described embodiment, only one column driver 10 is shown, it is usual that a plurality of column drivers 10 are provided and the column pins of an organic EL display panel, the number of which corresponds to the number of the horizontal lines, are assigned to the output terminals of the column drivers 10 to drive the panel in column direction. Therefore, in the present invention, it is possible to provide a plurality of column drivers 10.

INDUSTRIAL APPLICABILITY

In the described embodiment, the circuit construction of the organic EL drive circuit is for any one of R, G and B colors. Therefore, in a color organic EL drive circuit, the reference current setting circuit 2, the current distribution circuit 3, the reference current switching circuit 4, the D/A converter circuit 5 and the output stage current source 6 may be provided for each of the primary colors.

Further, since the reference currents are averaged in terms of time correspondingly to the row side scanning in this invention, the present invention is not limited to the organic EL panel of the passive matrix type and can be applied to an active matrix type organic EL panel, in which capacitors of pixel circuits are charged by drive currents.

Further, the output stage current source is not limited to the current discharge type and it is, of course possible to use the current sink type output stage current source.

DESCRIPTION OF REFERENCE NUMERALS AND SIGNS

Figure 1:
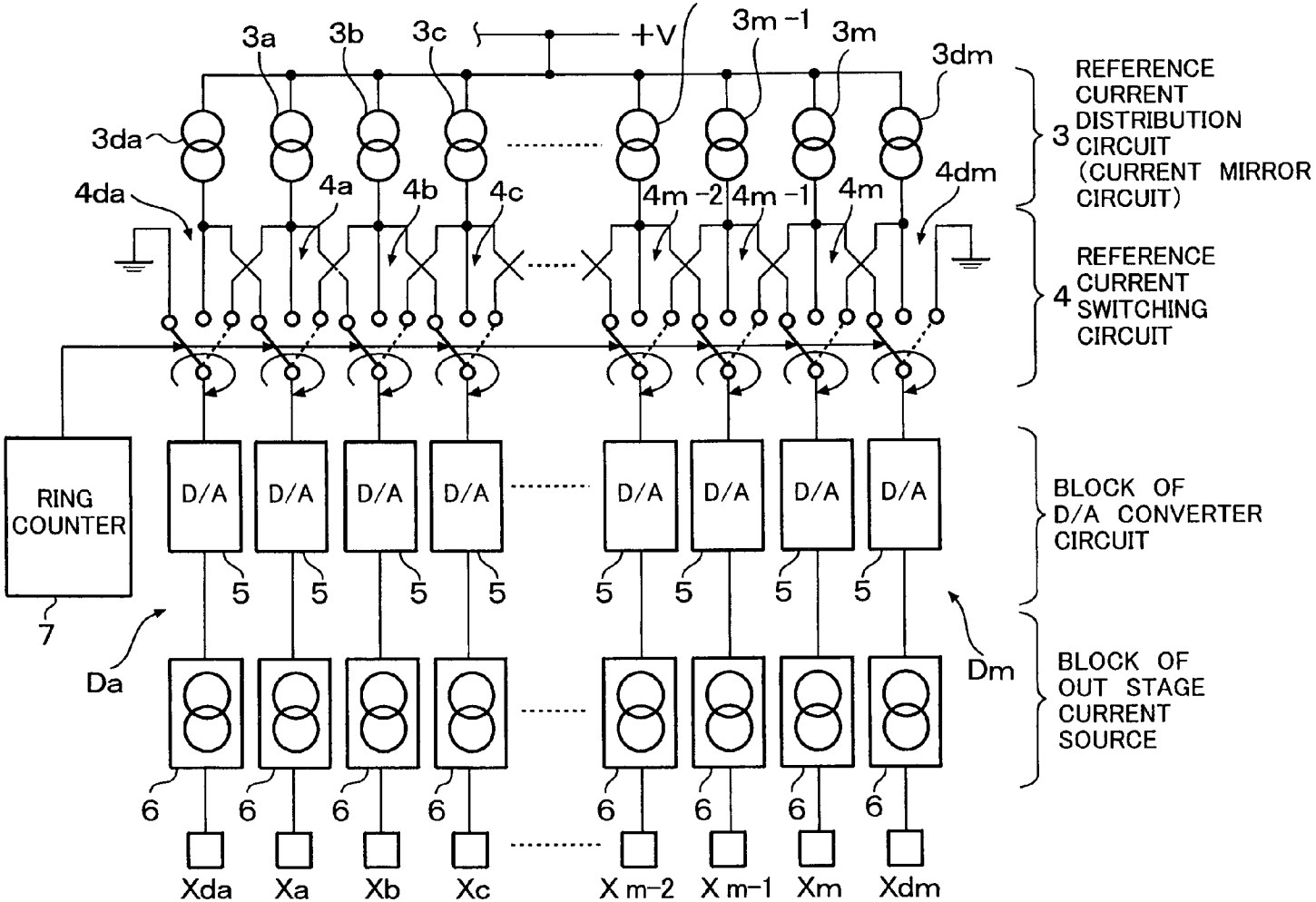
FIG. 1 is a block circuit diagram according to an embodiment of a column driver of an organic EL display device.
Figure 2:
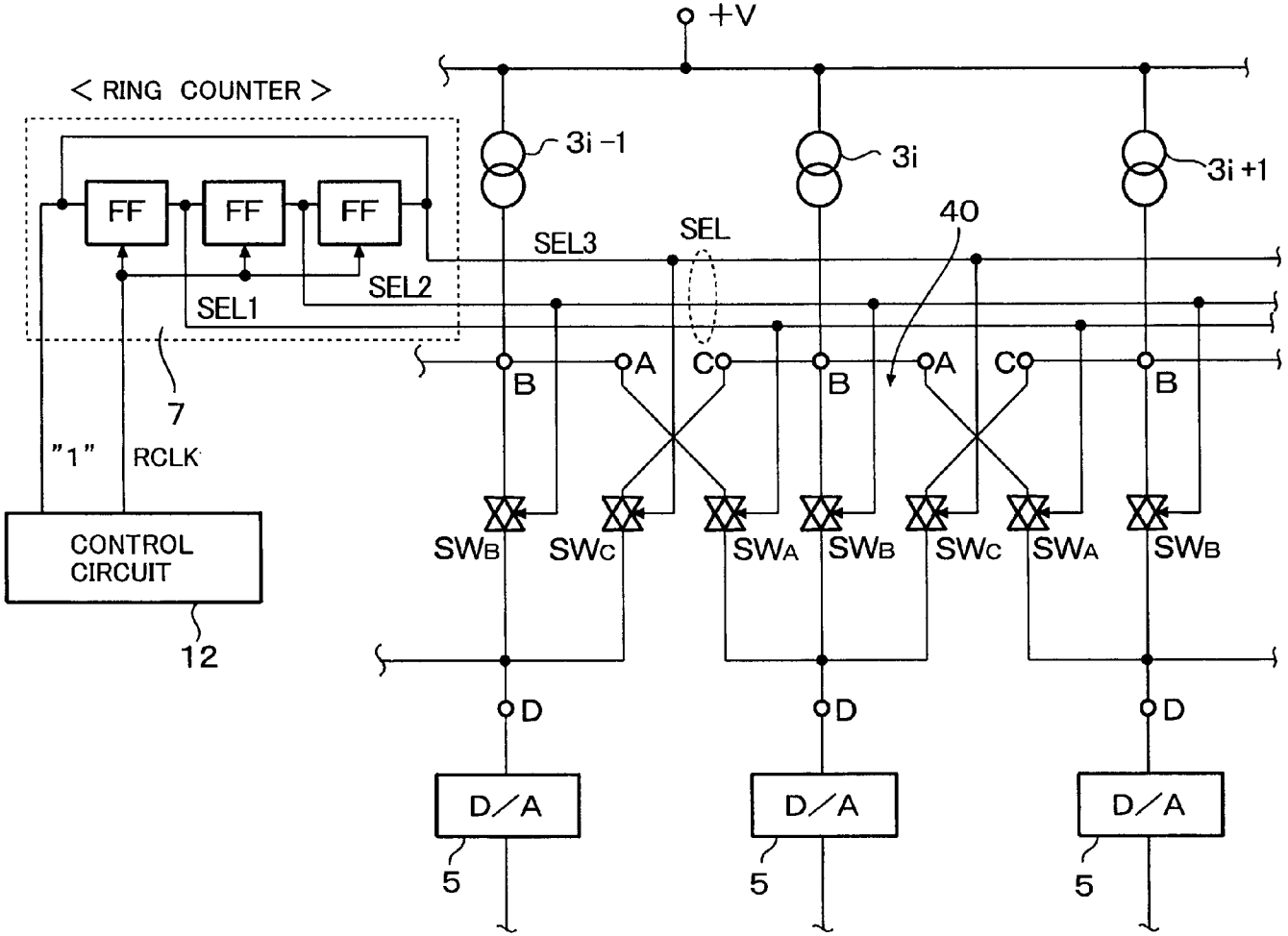
FIG. 2 shows a connection between a multiplexer and a ring counter in a reference current switching circuit of the column driver.
Figure 3:
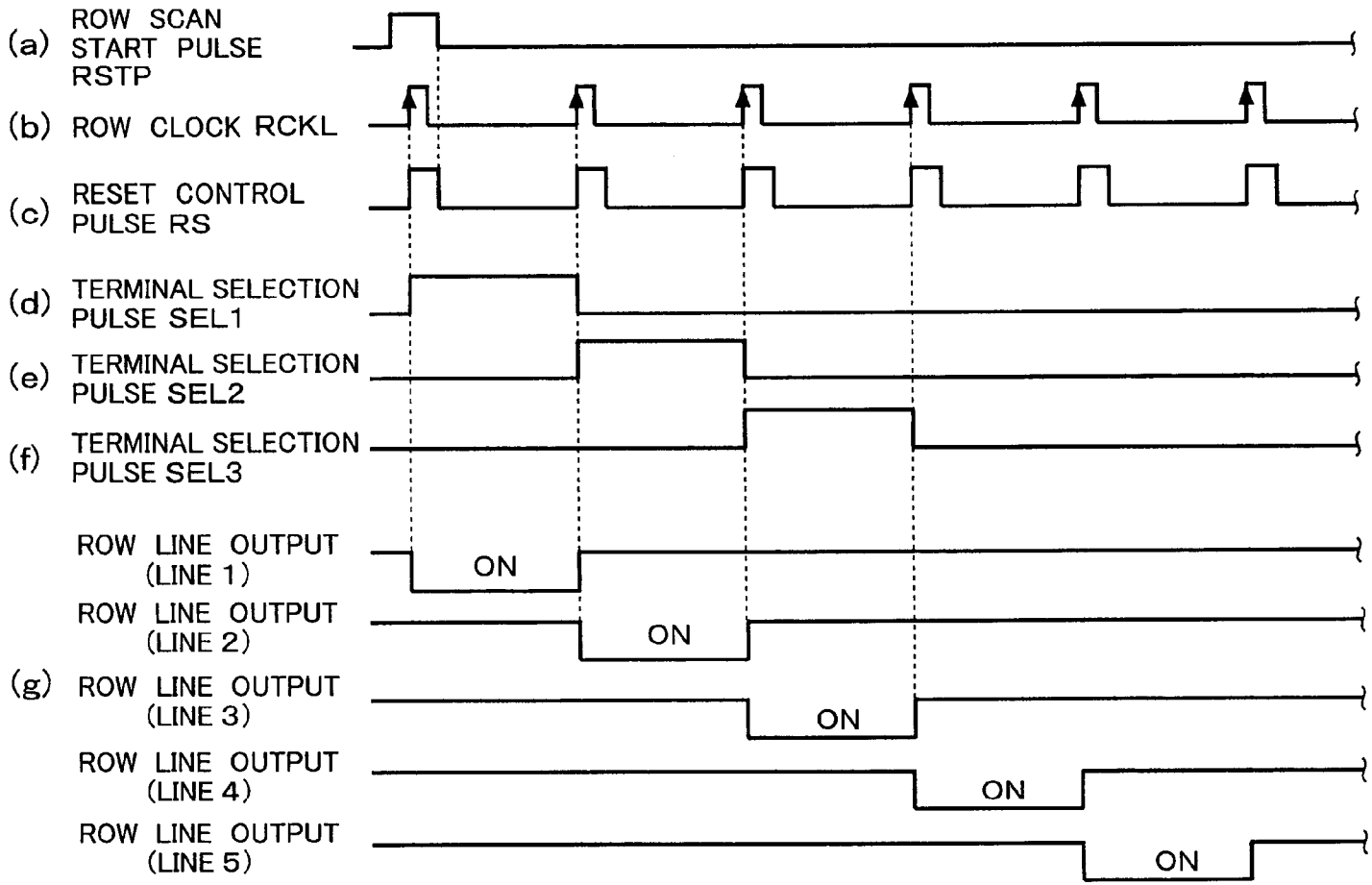
FIG. 3 shows timing signals in a reference current switching processing.
Figure 4:
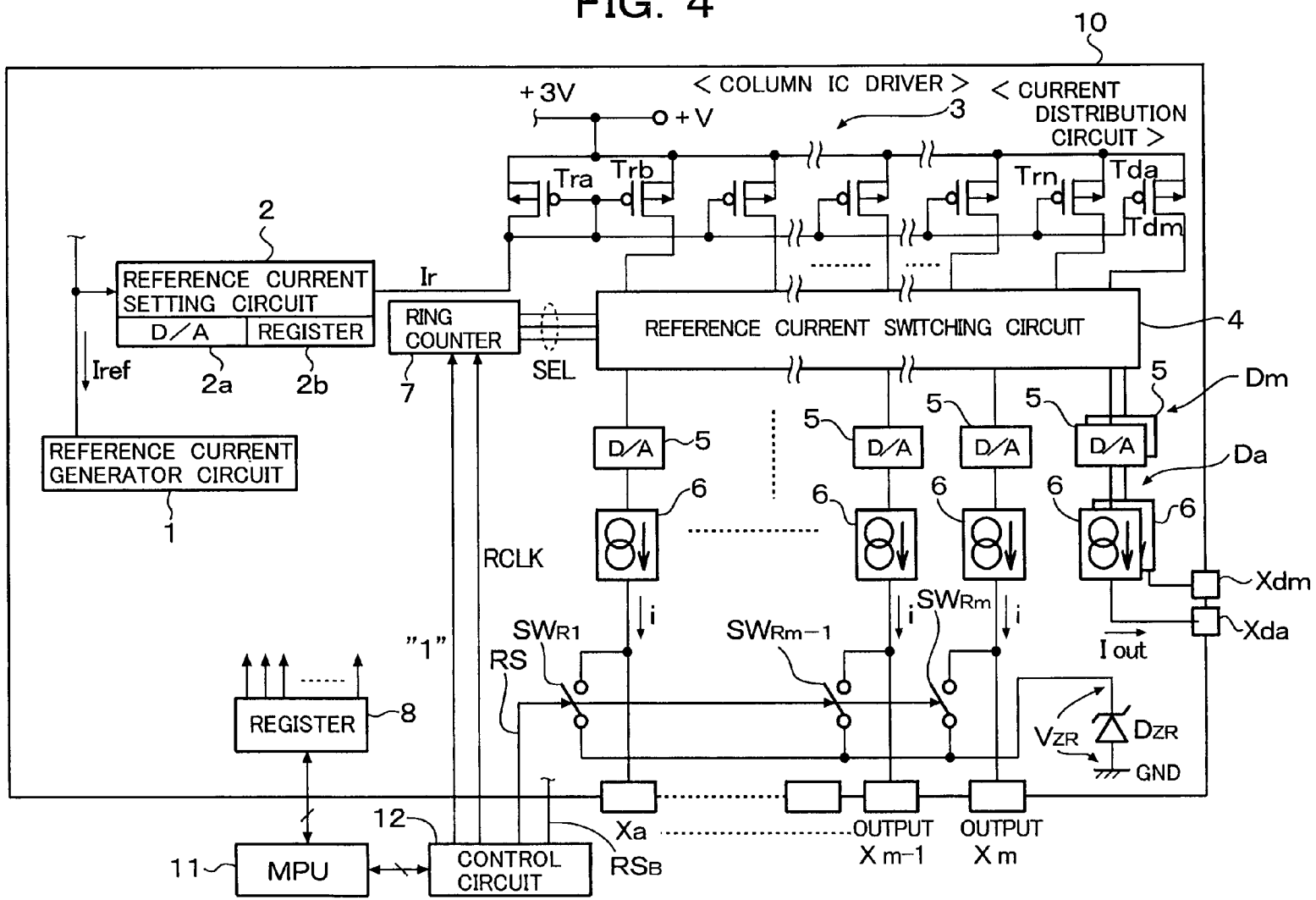
FIG. 4 is a block circuit diagram of the organic EL panel.

1 . . . reference current generator circuit
2 . . . reference current generator circuit
3 . . . current distribution circuit
4 . . . reference current switching circuit
5 . . . D/A converter circuit
6 . . . output stage current source
7 . . . ring counter
8 . . . register
10 . . . column IC driver
11 . . . MPU
12 . . . control circuit
4*a* to 4*m*, 4*da*, 4*dm*, 40 . . . multiplexer

The invention claimed is:

1. An organic EL drive circuit for current-driving an organic EL display panel by generating drive currents or a current, on which the drive currents are generated, correspondingly to respective output terminals connected to a number of column pins or terminal pins, comprising:

a plurality of current generator circuits provided correspondingly to the output terminals for generating predetermined currents correspondingly to the output terminals, respectively;

a plurality of current sources provided correspondingly to the output terminals and, in response to the predetermined currents from the current generator circuits correspondingly to the output terminals, for generating the drive currents or the current, on which the drive currents are generated, correspondingly to the output terminals, respectively; and a plurality of selection circuits provided between the current generator circuits and the current sources correspondingly to the output terminals, respectively, wherein the selection circuits select the predetermined current of the current generator circuits corresponding to the output terminals assigned to the selection circuits or the predetermined current from the current generator circuits corresponding to the output terminals adjacent to the current generator circuit, correspondingly to a row side scanning or a scan line scanning.

2. An organic EL drive circuit as claimed in claim 1, further comprising a control circuit for generating a predetermined control signal corresponding to the row side scan for one horizontal line to switch the selection of the selection circuit, wherein each of the selection circuits receives the predetermined current from the current generator circuits corresponding to the output terminal assigned thereto and the output terminal adjacent to the assigned output terminal according to the predetermined control signal and supplies the selected predetermined current to the current source corresponding to the assigned output terminal.

3. An organic EL drive circuit as claimed in claim 2, wherein the organic EL drive circuit is a driver IC and each of the selection circuits has at least n inputs, where n is an integer equal to or larger than 2, and one output, each of the n inputs receives the predetermined currents from the current generator circuits corresponding to the output terminal assigned to the selection circuit and to an output terminal adjacent to the assigned output terminal and the one output supplies the predetermined current inputted to any one of the n inputs to the current source corresponding to the output terminal assigned thereto to select one of the n inputs according to the predetermined control signal.

4. An organic EL drive circuit as claimed in claim 3, wherein the current generators are constructed with a current distribution circuit, which is response to the reference current to distribute currents each substantially equal to the reference current or currents each amplified to the output terminals and the predetermined currents in the current generator circuits are the output currents distributed to the output terminals, respectively.

5. An organic EL drive circuit as claimed in claim 4, wherein the current distribution circuit is constructed with a current mirror circuit having an input side transistor and n output side transistors, where n is an integer equal to or larger than the number of the output terminals, the current generator circuits are assigned to the n output side transistors, respectively, the input side transistor receives the reference current and generate the predetermined currents in the respective output side transistors, at least three of the n inputs of the selection circuits receive currents outputted by the output side transistors provided correspondingly to the assigned output terminal and the output terminals adjacent to the assigned output terminal as the predetermined currents.

6. An organic EL drive circuit as claimed in claim 5, further comprising a reference current generator circuit for generating the reference current and dummy current generator circuits each equivalent to the current generator circuit provided adjacent to an initial output terminal and a last output terminal of the output terminals, respectively, wherein the predetermined currents of the dummy current generator circuits are inputted to one of the n inputs of the selection circuit corresponding to the initial and last output terminals, respectively.

7. An organic EL drive circuit as claimed in claim 6, wherein n is 3, the selection circuit includes a 3-input, 1-output multiplexer provided correspondingly to each of the output terminals, the predetermined control signal is supplied to the multiplexers and is generated repeatedly with a row side scanning of 3 horizontal lines as a unit.

8. An organic EL drive circuit as claimed in claim 7, wherein the current source is constructed with a D/A converter circuit and an output stage current source for outputting the drive current, the D/A converter circuit is responsive to the predetermined current selected by the selection circuit corresponding to the assigned output terminal and display data to generate an analog converted current with which the output stage current source is driven.

9. An organic EL drive circuit as claimed in claim 5 wherein n is 3, the selection circuit includes a 3-input, 1-output multiplexer provided correspondingly to each of the output terminals, the predetermined control signal is supplied to the multiplexers and is generated repeatedly with a row side scanning of 3 horizontal lines as a unit.

10. An organic EL drive circuit as claimed in claim 6, wherein the control circuit includes a n-stage ring counter and the predetermined control signal is generated by shifting bit "1" or "0" from an initial stage to a last stage of the ring counter.

11. An organic EL display device comprising an organic EL drive circuit as claimed in claim 1 and the organic EL panel.

* * * * *